United States Patent [19]

Kelly et al.

[11] 4,090,599

[45] May 23, 1978

[54] METHOD AND APPARATUS FOR PERMANENT MARKING OF METAL

[76] Inventors: Calvin E. Kelly, 3558 Mayer Dr., Murrysville, Pa. 15668; John F. Lang, 336 W. 11th Ave., Homestead, Pa. 15120

[21] Appl. No.: 615,594

[22] Filed: Sep. 22, 1975

[51] Int. Cl.[2] ..... B44B 5/00; B41J 1/28

[52] U.S. Cl. ..... 400/134; 101/4; 101/18

[58] Field of Search ..... 101/3, 4, 9, 10, 11, 101/18, 19, 21, 26, 27, 28, 29, 30, 35, 41, 42, 368; 30/168; 7/8; 24/273; 197/6.4, 6.5, 6.6, 6.7; 33/184.5

[56] References Cited

U.S. PATENT DOCUMENTS

| | | | |
|---|---|---|---|
| 1,042,210 | 10/1912 | Ferris | 101/29 X |
| 1,253,463 | 1/1918 | Brown | 101/4 |
| 1,476,203 | 12/1923 | Horne | 101/4 |
| 1,504,598 | 8/1924 | Bergen | 197/6.7 |
| 1,576,682 | 3/1926 | Stapp | 30/168 |
| 1,611,722 | 12/1926 | Cross et al. | 197/6.7 |
| 1,632,966 | 6/1927 | Heinze | 101/368 |
| 1,746,229 | 2/1930 | Dyas | 197/6.7 |
| 1,868,997 | 7/1932 | Speicher | 101/29 X |
| 1,999,647 | 4/1935 | Atti | 101/4 X |
| 2,035,149 | 3/1936 | Dolan | 101/4 |
| 2,043,442 | 6/1936 | McNeil | 30/168 X |
| 2,113,867 | 4/1938 | Weymouth | 101/35 |
| 2,232,528 | 2/1941 | Hoffman | 101/29 |
| 2,242,505 | 5/1941 | Bolston | 101/18 |
| 2,285,956 | 6/1942 | Weber | 101/28 X |
| 2,337,127 | 12/1943 | Pannier | 101/28 |
| 2,393,515 | 1/1946 | Bradshaw | 30/168 |
| 2,594,685 | 4/1952 | Russell et al. | 101/4 |
| 2,842,046 | 7/1958 | Murray | 101/41 |
| 2,896,296 | 7/1959 | Huber | 24/273 |
| 2,896,530 | 7/1959 | Bernard | 101/4 |
| 2,908,505 | 10/1959 | Towers | 101/288 |
| 3,044,394 | 7/1963 | Munn | 101/28 |
| 3,160,090 | 12/1964 | Diegel | 197/6.7 X |
| 3,351,003 | 11/1967 | McCoy | 101/18 |
| 3,449,798 | 6/1969 | Hofmann | 24/273 X |
| 3,630,334 | 12/1971 | Connolly et al. | 197/6.7 |
| 3,828,664 | 8/1974 | Dikoff | 197/6.7 X |

*Primary Examiner*—Russell R. Kinsey
*Assistant Examiner*—Paul J. Hirsch
*Attorney, Agent, or Firm*—James O. Ray, Jr.

[57] ABSTRACT

A method and apparatus are disclosed for permanently marking a metal workpiece. The apparatus comprises a support for supporting the apparatus in contact with the workpiece. A stamp holding means adapted to receive a predetermined number of stamps engages the support and carries the stamps.

The method comprises the steps of engaging the stamp holder with the support. Placing the support on the workpiece. Striking the stamps until the characters are at the desired depth and then removing the stamp holder from the workpiece.

18 Claims, 7 Drawing Figures

METHOD AND APPARATUS FOR PERMANENT MARKING OF METAL

BACKGROUND OF THE INVENTION

This invention relates in general to marking metal workpieces and, more particularly, to a method and apparatus for placing permanent marks on metal workpieces.

Prior to our invention steel hand stamps were used extensively to permanently identify metal workpieces, such as rolling mill roll necks. However, conventional steel stamping did not ensure the legibility or accuracy required. The primary reasons for this was the marks varied with the surfaces to be marked and also the dexterity of the person doing the marking.

Therefore, the need for a reliable method of identifying mill rolls has been apparent in the steel industry for some time. Proper reconditioning of mill rolls is often difficult, if not impossible, because of incorrect or illegible identification of the rolls.

Steel hand stamps are extensively used to provide identifying marks on steel-mill-roll necks. The use of these hand stamps often results in poor legibility, and for hardened steel rolls, it is hazardous to personnel because of flying chips. Consequently, a method of identifying mill rolls that will ensure permanent, legible markings and that is safe to use was required. In addition, it was desirable that such a marking apparatus minimize errors in characters selected and the number of marking man-hours.

OBJECTS OF THE INVENTION

It is therefore the primary object of our invention to provide a method and apparatus for identifying steel rolls which will ensure permanent, legible markings and which is safe to use even by inexperienced personnel.

Another object of our invention is to provide a method and apparatus that eliminates the need for manual changing of the stamp characters, thereby minimizing errors in stamp selection and placement.

A further object of our invention is to provide a marking apparatus that will protect marking personnel from flying metal chips from the metal workpiece being marked.

A still further object of our invention is to provide a marking apparatus that reduces manual fatigue and simplifies the marking operation.

Yet another object of our invention is to provide a method and apparatus that reduces the number of man-hours required for identification.

A still further object of our invention is to provide identification marks that will survive the life of the workpiece and remain legible.

These and various other objects and advantages of our invention will become more apparent from the following detailed description and drawings.

BRIEF SUMMARY OF OUR INVENTION

A method and apparatus are described for permanently marking a metal workpiece. The apparatus comprises a support for supporting the apparatus in contact with the workpiece. A stamp holding means adapted to receive a predetermined number of stamps engages the support and carries the stamps.

The method comprises the steps of engaging the stamp holder with the support. Placing the support on the workpiece. Striking the stamps until the characters are at the desired depth and then removing the stamp holder from the workpiece.

DESCRIPTION OF THE PREFERRED AND ALTERNATE EMBODIMENTS

Figure 7:
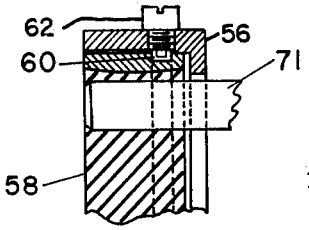
FIG. 7 is a sectional view taken on line VII—VII of FIG. 2.
Figure 6:
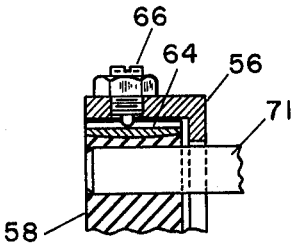
FIG. 6 is a sectional view taken on line VI—VI of FIG. 2.

Referring to FIGS. 1, 2, 3, 6, and 7, the marking apparatus of our invention comprises a means for supporting the apparatus, generally designated as 10, in contact with the workpiece 12. The support 10 comprises a horizontal saddle plate 14 having legs 16 adapted to contact the workpiece 12 at two points when the workpiece 12 is generally round such as a rolling mill roll neck. Secured to the horizontal saddle plate 14 is an upstanding guide plate 18 having a nut 20 secured thereto.

Pivot plates 22 having vertical slots 24 and lock ears 26 are secured to the top of horizontal saddle plate 14. Strap wrench 28 with strap 30 is pivotally attached to pivot plates 22 with a pivot pin 32 secured to pivot plates 22 with washers 34 and snap ring 36. The strap wrench handle 38 is adapted to receive lock pin 40 slidably mounted on handle 38 by a lock lever 42.

The stamp holder frame, generally designated as 50, comprises a vertical slide plate 52 having a vertical slot 54 for linear adjustment and cylindrical housing 56 counterbored to receive the stamp drum 58. The stamp drum 58 is rotatably mounted in housing 56 and loosely retained therein by means of a groove 60 in its outer periphery and shoulder screws 62. A series of positioning slots 64 are also provided in the periphery of the stamp drum 58. Mounted in the periphery of the housing 56 is a spring plunger 66 for retaining the drum 58 in one of the slots 64 positions. The stamp drum 58 contains appropriate stamp characters 70 molded into its face in a predetermined configuration.

The stamp drum 58 is preferrably made from a rubber-like substance such as a urethane rubber of medium durometer molded into a cylindrical drum shape but it may also be made from vinyl or plastic. The drum 58 also has rectangular holes molded therein of a size to provide a push fit on steel stamps 71 to retain them in drum 58. The outside surface of housing 56 is properly indexed (at top and bottom) for each stamp position by scribe grooves 76 for successive positions of groove 64 spacings.

A sleeve 73, made of rubber, vinyl or plastic, is pressed onto stamps 71 a predetermined distance d'. The sleeve 73 extends outwardly a second predetermined distance d. The sleeve 73 prevents spalled chips from the stamps 71 when the stamps 71 are struck for marking. It should be understood by those skilled in the art that the sleeve 73 would also be useful for any metal member which is subject to an impact from another object.

Figure 3:
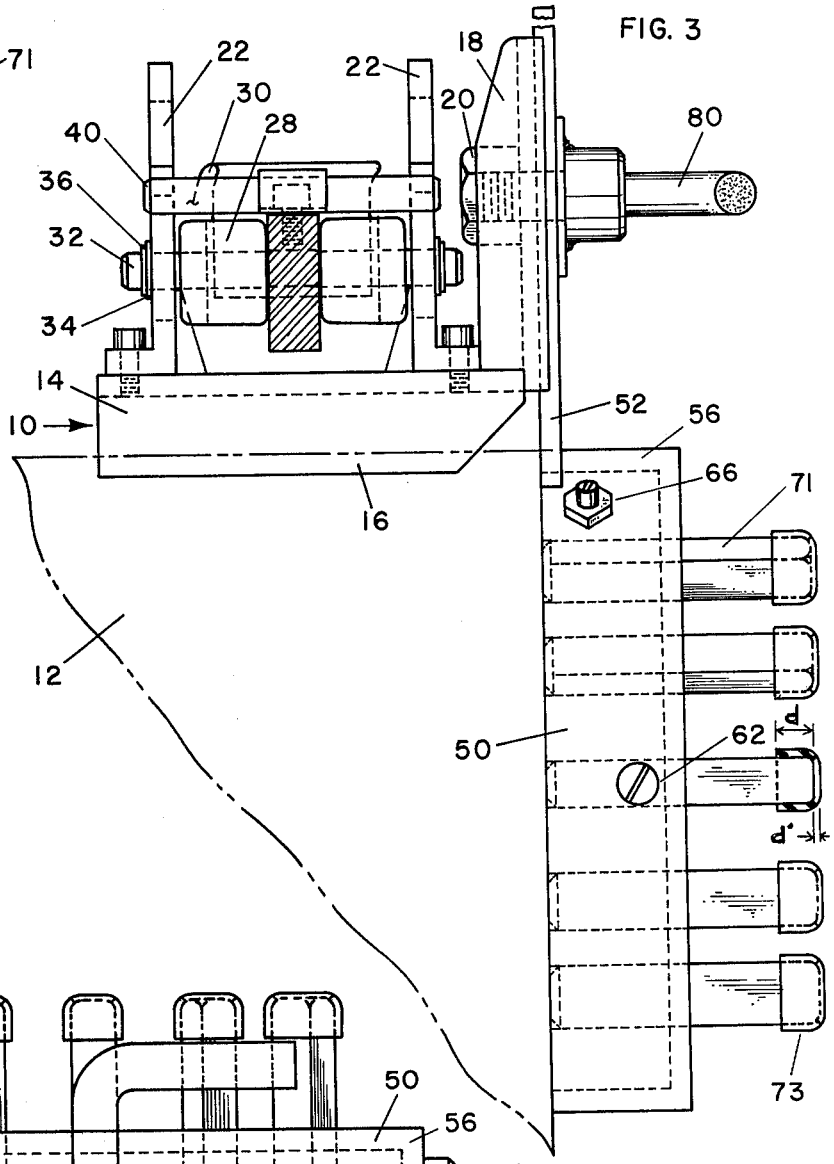
FIG. 3 is a side view of the marking apparatus shown in FIG. 1.
Figure 1:
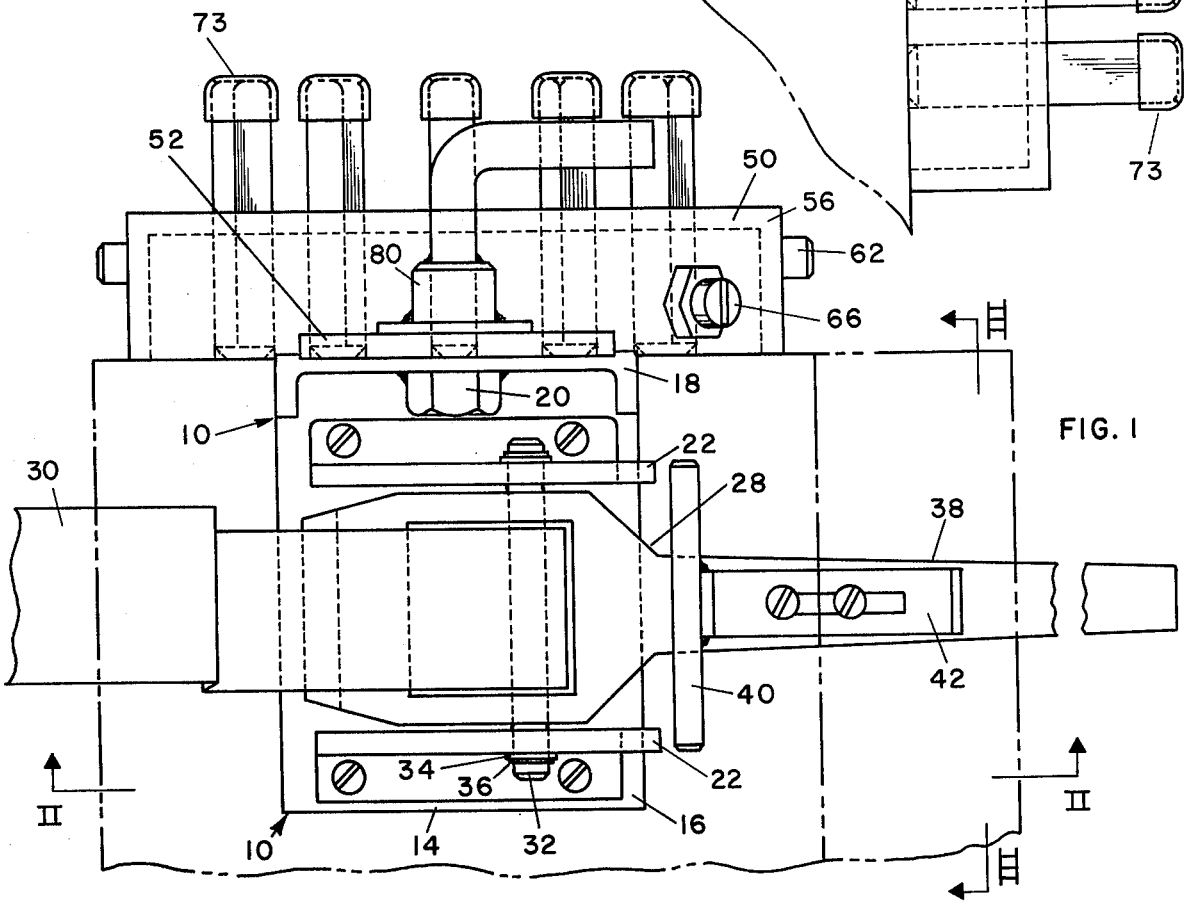
FIG. 1 is a top view of the marking apparatus of our invention.
Figure 2:
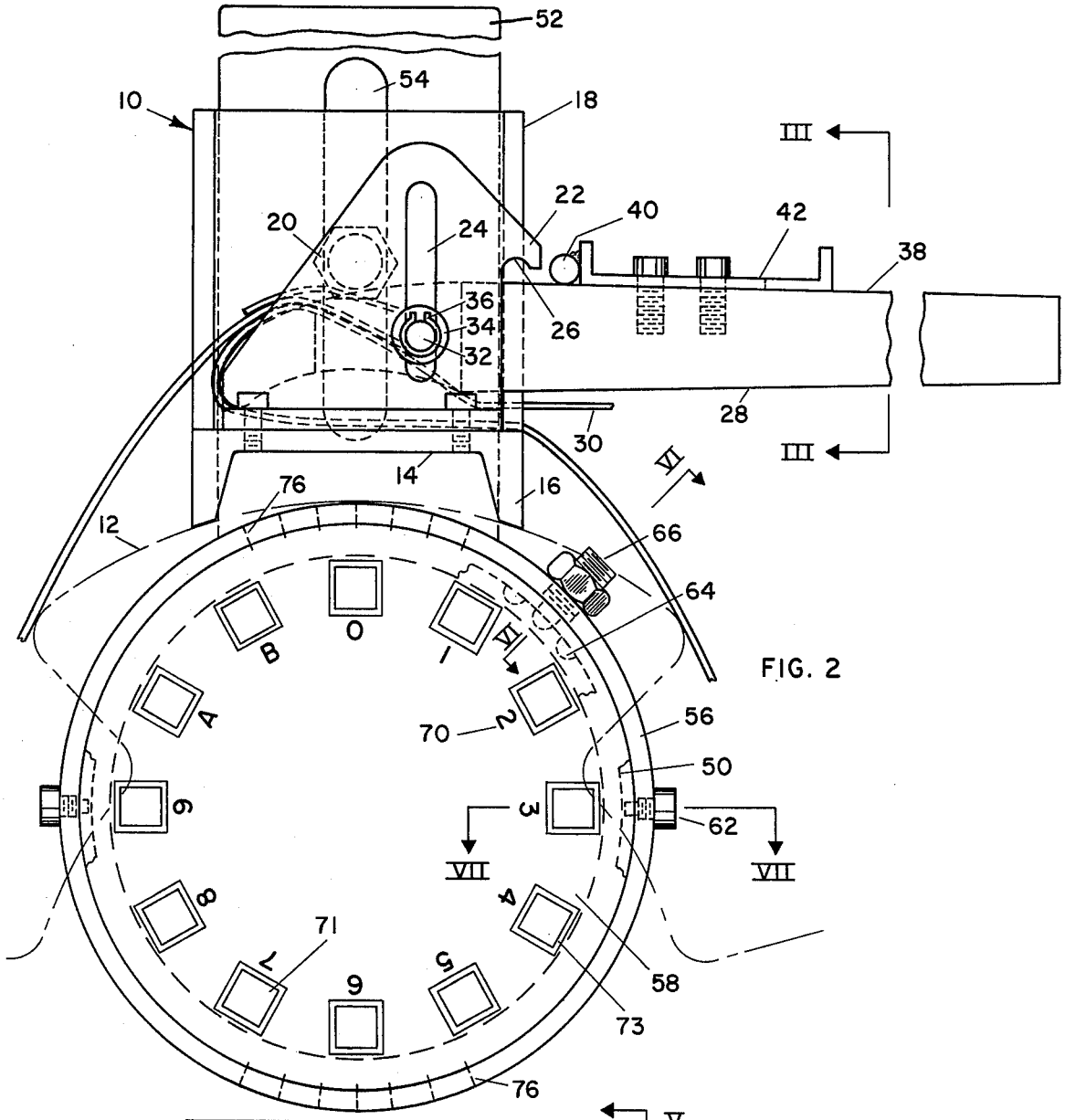
FIG. 2 is a front view of the apparatus shown in FIG. 1.

In operation, the support bracket 10 is positioned on the neck of workpiece 12, as shown in FIG. 2 until frame 50 is flush with the face of workpiece 12, as shown in FIG. 3. The strap 30 is then pulled snug around workpiece 12 and the wrench handle 38 is then rotated clockwise, as shown in FIG. 2, to tighten strap 30 on the workpiece 12. The lock lever 42 is then pushed forward forcing pin 40 into ears 26 to hold the handle 38 against the tension in safety strap 30 thus locking bracket 10 on workpiece 12. The stamp holder frame 50 is then properly positioned vertically adjacent the workpiece 12 by loosening a lock screw 80 and positioning the frame 52 and again tightening the screw 80. The drum 58 is then rotated until the desired steel stamp 71 is positioned on the first scribe groove 76. This stamp 71 can now be struck as many times as necessary to provide the desired penetration depth. When a stamp 71 is struck, the flexible drum 58 moves forward against the workpiece 12 face due to the friction between the stamp 71 and the drum 58 preventing metal chips from injuring marking personnel. Subsequent numbers or letters are simply "dialed" into position in a similar manner. It is to be noted that the stamp 71 is not manually held thereby preventing injury to marking personnel. Stamp dialing also prevents incorrect number selection or placement or orientation. After all desired characters are stamped, the lock lever 42 is retracted permitting the counter-clockwise rotation of the handle 38 thereby loosening the strap 30. The unit can now be removed from the workpiece 12.

Figure 4:
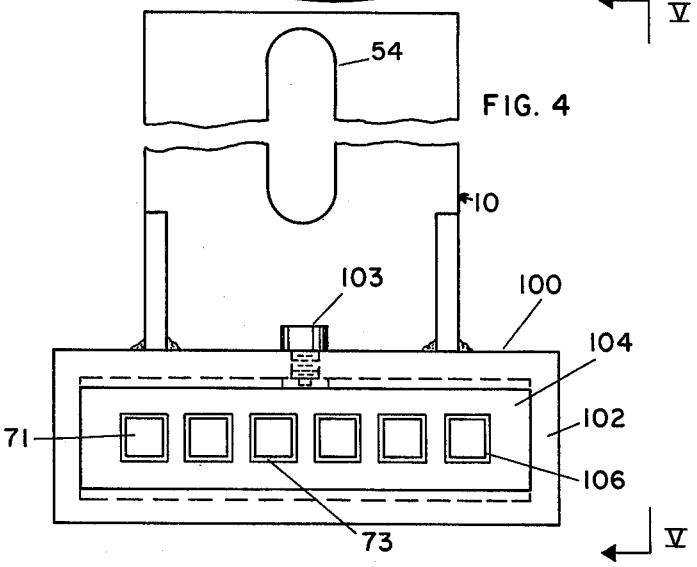
FIG. 4 is a front view of an alternate stamp holder of our invention.
Figure 5:
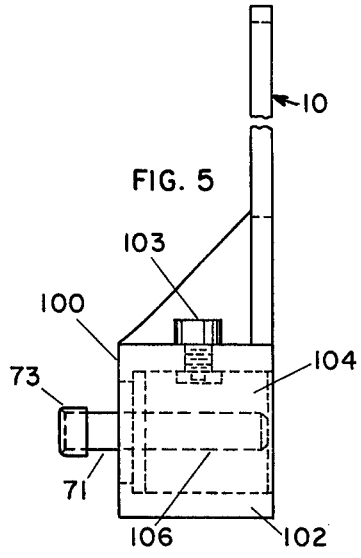
FIG. 5 is a side view of the stamp holder shown in FIG. 4.

An alternate design, shown in FIGS. 4 and 5, utilizes a similar support bracket 10. The stamp holder frame 100, however, contains a hollow rectangular housing 102, which contains a rubber stamp block 104 with a line series of rectangular holes 106 molded therein. It is to be understood however that any configuration of stamp arrays can be used. Block 104 is loosely retained in housing 102 by shoulder screw 103.

In operation, the unit is attached to the workpiece 12 as before and the block 102 with the stamp holder 104 is vertically positioned on the workpiece 12 by loosening the lock screw 80. Screw 80 is then locked. The steel stamps 71 which have previously been inserted in block 104 can now be manually struck. Again, the holder 104 remains in intimate contact with the workpiece 12 by the free movement of the block 104 relative to frame 102 preventing accidental injury to marking personnel. In this case, however, each stamp 71 is struck in succession without repositioning the holder 102 or the rubber block 104.

Both units maintain the stamps 71 perpendicular to the workpiece 12 during the marking operation to ensure a proper impression.

During the stamping operation of either embodiment when the stamp head 75 is struck the rubber-like sleeve 73 is compressed slightly the distance d as shown in FIG. 3 to prevent spalled chips from flying as a result of spalling from either the hammer or the stamp 71.

Although this sleeve is described in conjunction with use in marking it applies equally as well for other applications. For example, the sleeve could be employed on chisel heads, hammers, and any other such tools requiring an impact for operation.

While we have described our preferred and alternate embodiments of our invention, it will be understood by those skilled in the art that various other alternatives and combinations of our invention can be practiced and we intend only to be bound by the scope of the appended claims.

We claim:

1. An apparatus for marking a metal workpiece, comprising:

a. means for supporting said apparatus in contact with said metal workpiece to be marked, said means comprising:
   1. a plate;
   2. at least two legs attached to and depending from said plate so that said support will accommodate different size workpieces; and
   3. means for securing a stamp holder frame to said plate;

b. a stamp holder frame for receiving a stamp holding means engageable with said means for supporting said apparatus, said frame comprising:
   1. a housing;
   2. a slide plate engageable by said means for securing said frame to said support plate through a vertical slot in said slide plate, said slide being secured to the outer periphery of said housing so that said housing can be adjusted in a plane parallel to the face of said workpiece to be marked; and
   3. means for loosely retaining a flexible stamp holding means in said housing;

c. a flexible stamp holding means, having a groove on at least a portion of the periphery thereof for engagement therein of said means for retaining said stamp holding means in said housing and having holes molded therein of a size to provide a push fit on a stamp means, movably mounted in said stamp holder frame; and d. stamp means carried by said flexible stamp holding means.

2. An apparatus according to claim 1 wherein said metal workpiece to be marked is generally round.

3. An apparatus according to claim 1 further comprising a means, secured to said means for supporting said apparatus, to fixedly hold said apparatus in the desired position.

4. An apparatus according to claim 3 wherein said means to fixedly hold said apparatus is an adjustable strap means secured to said means for supporting said apparatus, and said strap means surrounds said metal workpiece so that said apparatus is held in the desired position.

5. An apparatus according to claim 1 wherein said stamp holding means holds said stamps in a predetermined configuration.

6. An apparatus according to claim 1 wherein said stamp holding means is a rotatable member and includes means for retaining said rotatable member in said stamp holding means.

7. An apparatus according to claim 6 further including means for maintaining said rotatable member in a preselected position during operation.

8. An apparatus according to claim 6 further including means for indexing said rotatable member to select successive characters to be stamped.

9. An apparatus according to claim 6 wherein said means for retaining said rotatable member permits said rotatable member to float.

10. An apparatus according to claim 1 wherein said flexible member is selected from the group consisting of rubber, vinyl and plastic.

11. A method for placing a permanent mark on a metal workpiece, said method comprising the steps of:

a. placing a support on said metal workpiece which contacts said workpiece at least at two points by legs secured to and depending from a plate;

b. engaging said support with a slide plate through a vertical slot in said slide plate and which is secured to a housing having a flexible stamp holder, containing a predetermined number of stamps, said stamp holder having a groove on at least a portion of the periphery thereof to accommodate being loosely retained in said housing, in a manner such that said stamps are held perpendicular to said metal workpiece;

c. adjusting said slide plate, in a plane parallel to the face of said workpiece to be marked, to the desired position;

d. striking said stamps until the characters are at the desired penetration depth; and e. removing said housing and said support from said metal workpiece.

12. A method according to claim 11 including the additional step of fixedly holding said support in the desired position during operation.

13. A method according to claim 11 including the additional step of engaging an adjustable strap in contact with said metal workpiece prior to step (c) to hold the assembly in the desired position during operation and then removing said adjustable strap prior to step (d).

14. A method according to claim 13 wherein step (b) is performed prior to step (a).

15. A method of placing a permanent mark on a metal workpiece, said method comprising the steps of:

a. placing a support on said metal workpiece which contacts said workpiece at least at two points by legs secured to and depending from a plate;

b. engaging said support with a slide plate through a vertical slot in said slide plate and which is secured to a rotatable drum stamp holder housing having a flexible stamp holder, containing a predetermined number of stamps, rotatably and loosely retained in said stamp holder housing, in a manner such that said stamps are held perpendicular to said metal workpiece;

c. adjusting said slide plate, in a plane parallel to the face of said workpiece to be marked, to the desired position;

d. rotating said flexible stamp holder to position the desired character stamp at the desired position;

e. striking said stamp until the character is at the desired penetration depth;

f. repeating steps (d and e) until all predetermined characters have been marked on said metal workpiece; and g. removing said stamp holder housing and said support from said metal workpiece.

16. A method according to claim 15 including the additional step of fixedly holding said support in the desired position during operation.

17. A method according to claim 15 including the additional step of engaging an adjustable strap in contact with said support and said metal workpiece prior to step (c) to hold the assembly in the desired position during operation and then removing said adjustable strap after step (e).

18. A method according to claim 17 wherein step (b) is performed prior to step (a).

* * * * *